United States Patent [19]

Fujii et al.

[11] Patent Number: 4,771,140

[45] Date of Patent: Sep. 13, 1988

[54] CIRCUIT INTERRUPTER

[75] Inventors: Hiroshi Fujii; Tsukasa Iio; Yasusi Genba; Hideaki Moriwaki; Yoshinori Mochizuki, all of Fukuyama, Japan

[73] Assignee: Mitsubishi Denki Kabushiki Kaisha, Japan

[21] Appl. No.: 94,447

[22] Filed: Sep. 9, 1987

[30] Foreign Application Priority Data

Sep. 11, 1986 [JP] Japan ..... 61-141016[U]

[51] Int. Cl.[4] ..... H01H 33/20

[52] U.S. Cl. ..... 200/144 R

[58] Field of Search ..... 200/144 R

[56] References Cited

U.S. PATENT DOCUMENTS 4,642,428 2/1987 Yoshiyasu et al. ..... 200/144 R

*Primary Examiner*—Robert S. Macon

*Attorney, Agent, or Firm*—Leydig, Voit & Mayer

[57] ABSTRACT

A circuit interrupter comprising a stationary contact assembly having a stationary contact element securely attached to a stationary conductor, and a movable contact assembly having a movable contact element secured on a movable contact arm and operable in response to an overcurrent between ON and OFF positions relative to the stationary contact assembly. An arc runner is attached to the stationary conductor by a single rivet and includes an elongated main body extending along the stationary conductor for expanding an electric arc generated between the movable and the stationary contact elements upon current interruption. The circuit interrupter further comprises a pair of tabs mounted to the arc runner for defining a pair of sloped engagement surfaces for receiving and positioning therebetween the stationary conductor when the stationary contact assembly is assembled.

3 Claims, 1 Drawing Sheet

CIRCUIT INTERRUPTER

BACKGROUND OF THE INVENTION

This invention relates to a circuit interrupter having an arc runner and, more particularly to a structure for mounting an arc runner on a stationary contact.

FIG. 1 is a partial sectional side view of one example of the conventional circuit interrupter to which the present invention pertains. In FIG. 1, the circuit interrupter comprises an electrically insulating housing 1, which contains therein a movable contact assembly 2, a stationary contact assembly 3, an arc extinguisher 4 and a perforated insulating partition wall 7.

The movable contact assembly 2 has a movable contact element 201 supported by a movable contact arm 202 which is connected to an operating mechanism (not shown) as is well known in the art. The stationary contact assembly 3 comprises a stationary contact element 301, a stationary contact carrying conductor 302 carrying the stationary contact element 301, an arc runner 5 secured to the conductor 302 by a rivet 6, and a terminal portion 303 for external connection. The arc extinguisher 4 composed of a plurality of arc extinguishing plates 401 is disposed within an arc extinguishing chamber 402 defined in the vicinity of the arcing region in which an electric arc is generated between the separated contacts 201 and 301. The insulating partition wall 7 having a plurality of perforations 701 is disposed between the arc extinguishing chamber 402 and the terminal portion 303 of the stationary contact assembly 3 for preventing the ingress of any foreign matter into the interior of the circuit interrupter and for preventing the arced gas from scattering at random and melting the surrounding elements.

With the conventional circuit interrupter as above described, the arc runner 5 is mounted on the conductor 302 by a single rivet 6. Therefore, the arc runner 5 often rotates about the rivet 6 due to mechanical shocks received during current interruption and unbalanced electromagnetic force acting on the arc runner 5. When this rotation of the arc runner 5 occurs, the electric arc generated between the separated contacts 201 and 301 cannot be drawn to a proper position within the arc extinguishing chamber 4, resulting in a failure in interruption. Also, the electrical connection between the arc runner 5 and the stationary conductor 302 becomes loose and less efficient and provides a relatively large electrical resistance between them. If the arc runner 5 is to be secured to the stationary conductor 302 by means of two rivets, a step of forming an additional rivet hole in the stationary conductor 302 as well as a step of swaging the additional rivet are required, to increase the number of assembly steps and the parts of the contact arm assembly 3.

SUMMARY OF THE INVENTION

Accordingly, an object of the present invention is to provide a circuit interrupter in which even through only one rivet is used to secure the arc runner it is still prevented from rotating relative to the stationary conductor.

Another object of the present invention is to provide a circuit interrupter in which the arc runner can be securely mounted on the stationary conductor with simple assembly steps.

A further object of the present invention is to provide a circuit interrupter in which a good electrical contact relationship can be established with a simple structure.

With the above objects in view, the circuit interrupter of the present invention comprises a stationary contact assembly having a stationary contact element securely attached to a stationary conductor, and a movable contact assembly having a movable contact element secured on a movable contact arm and which is operative in response to an overcurrent between ON and OFF positions relative to the stationary contact assembly. An arc runner is attached to the stationary conductor by a single rivet and includes an elongated main body extending along the stationary conductor for expanding an electric arc generated between the movable and the stationary contact elements separated upon current interruption. The circuit interrupter further comprises a pair of tabs mounted to the arc runner for defining a pair of sloped engagement surfaces for receiving and positioning therebetween the stationary conductor when the stationary contact assembly is assembled.

BRIEF DESCRIPTION OF THE DRAWINGS

Throughout the figures, the same reference numerals designate identical or corresponding components.

DESCRIPTION OF THE PREFERRED EMBODIMENT

Figure 2:
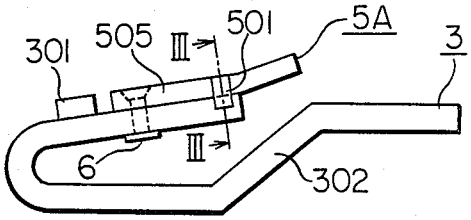
FIG. 2 is a side view illustrating the stationary contact assembly used in the circuit interrupter of the present invention.
Figure 3:
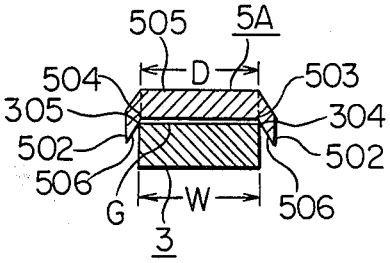
FIG. 3 is a cross sectional view taken along line III—III of FIG. 2.

One embodiment of the present invention will now be described in conjunction with FIGS. 2 and 3, in which FIG. 2 is a side view illustrating the stationary contact assembly used in the circuit interrupter of the present invention, and FIG. 3 is a cross sectional view taken along line III—III of FIG. 2.

Figure 1:
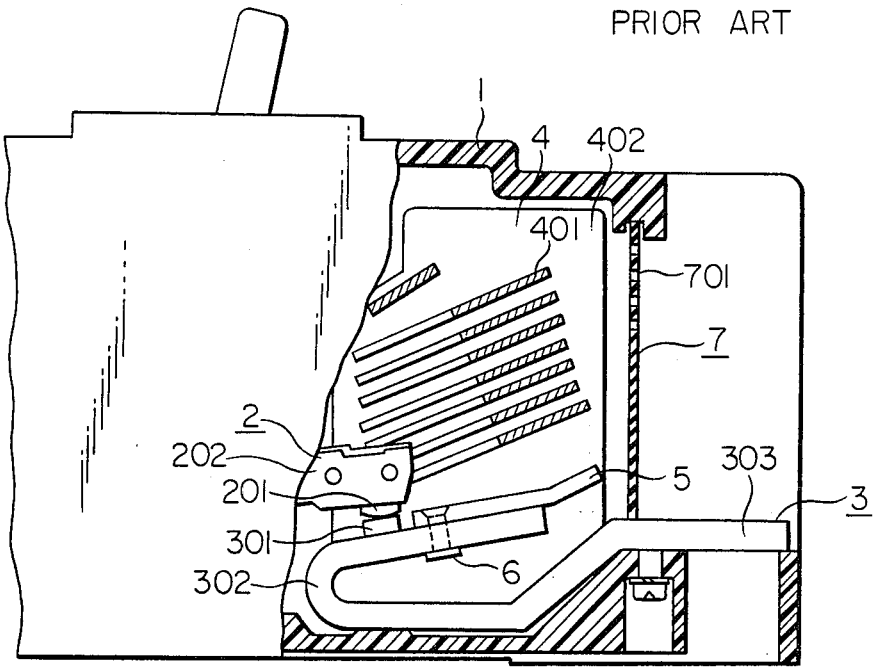
FIG. 1 PRIOR ART
FIG. 1 is a partial sectional side view illustrating a stationary contact assembly of the conventional circuit interrupter.

The circuit interrupter of the present invention has a construction identical to the conventional construction described and illustrated in conjunction with FIG. 1 except for the structure of the arc runner 5A as shown in FIGS. 2 and 3. The circuit interrupter of the present invention comprises a stationary contact assembly 3 having a stationary conductor 302, a stationary contact element 301 securely attached to the stationary conductor 302 as shown in FIG. 2. Similar to the conventional circuit interrupter illustrated in FIG. 1, the circuit interrupter of the present invention also comprises a movable contact assembly 2 having a movable contact arm 202 and a movable contact element 201 and operative in response to an overcurrent between ON and OFF positions relative to the stationary contact assembly 3. The circuit interrupter further comprises an arc runner 5A attached to the stationary conductor 302 by a single rivet 6. The arc runner 5A has an elongated main body 505 extending along the stationary conductor 302 for expanding an electric arc (not shown) generated between the movable contact element 201 and the stationary contact element 301 when they are separated upon current interruption.

According to the present invention, the arc runner 5A is provided with a pair of tabs 502 integrally extending laterally from the side of the arc runner 302. The tabs 502 are bent downward at an angle as seen in FIG. 3 so that sloped surfaces 506 extend at an angle from the lower side edges 503 and 504 of the arc runner 5A. It is seen in FIG. 3 that the width D of the arc runner 5A is smaller than the width W of the stationary conductor 302, so that a very small gap G is defined between the arc runner 5A and the stationary conductor 302 at least at the position where the tabs 502 are provided even when the arc runner 5A and the stationary conductor 302 are firmly connected by the rivet 6. This gap G between the arc runner 5A and the stationary conductor 302 are maintained even when the tabs 502 bite into the side edges 304 and 305 of the stationary conductor 302. Thus, during and after assembly, the sloped surfaces 506 of the tabs 502 function to guide and position and maintain the arc runner 5A relative to the stationary conductor 302. The sloped surfaces 506 of the tabs 502 also establish a good electrical connection between the arc runner 5A and the stationary conductor 302.

What is claimed is:

1. A circuit interrupter comprising:

a stationary contact assembly having a stationary conductor and a stationary contact element securely attached to said stationary conductor;

a movable contact assembly having a movable contact arm and a movable contact element operable in response to an overcurrent between ON and OFF positions relative to said stationary contact assembly; and an arc runner attached to said stationary conductor by a single rivet and expanding an electric arc generated between said movable and said stationary contact elements upon current interruption;

said arc runner having an elongated main body extending along said stationary conductor and lateral edges providing a pair of engagement surfaces sloping outwardly at an acute angle from said main body and receiving and positioning therebetween said stationary conductor when said stationary contact assembly is assembled.

2. A circuit interrupter according to claim 1 wherein said elongated main body of said arc runner has a width smaller than the width of said stationary conductor.

3. A circuit interrupter according to claim 1 wherein said stationary conductor is positioned to provide a gap between said arc runner and said stationary conductor.

* * * * *